US006247605B1

(12) United States Patent
Fujie et al.

(10) Patent No.: US 6,247,605 B1
(45) Date of Patent: Jun. 19, 2001

(54) INNER PLUG AND CAP FOR LIQUID INJECTION CONTAINERS, AND JIG USED TO FIX CAP TO INNER PLUG

(75) Inventors: Takashi Fujie; Masaru Tamura; Takao Kishi, all of Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 09/463,060

(22) PCT Filed: May 21, 1999

(86) PCT No.: PCT/JP99/02691

§ 371 Date: Jan. 19, 2000

§ 102(e) Date: Jan. 19, 2000

(87) PCT Pub. No.: WO99/61334

PCT Pub. Date: Dec. 2, 1999

(30) Foreign Application Priority Data

May 22, 1998 (JP) ..... 10-158500
Sep. 18, 1998 (JP) ..... 10-283517
Sep. 18, 1998 (JP) ..... 10-283518

(51) Int. Cl.[7] ..... B65D 41/34
(52) U.S. Cl. ..... 215/256; 215/254
(58) Field of Search ..... 215/256, 254, 215/356

(56) References Cited

U.S. PATENT DOCUMENTS 4,171,749 * 10/1979 Obrist et al. ..... 215/256
5,810,207 * 9/1998 Hayashida ..... 222/153.07
6,016,931 * 1/2000 Ohmi et al. ..... 215/256

* cited by examiner

*Primary Examiner*—Stephen Castellano
(74) *Attorney, Agent, or Firm*—Oliff & Berridge, PLC

(57) ABSTRACT

The present invention provides an inner plug easily removable from a neck of a container, and a cap for covering the inner plug. The inner plug comprises an engaging portion to be fitted to a neck of the container, a threaded cylinder and a lip cylinder connected to said threaded cylinder. The engaging portion comprises an inner cylinder, an outer cylinder and a shoulder wall. The threaded cylinder is arranged on the inner cylinder. The cap has a side cylinder to be engaged with said threaded cylinder of said inner plug, and a cover cylinder covering said shoulder wall and said outer cylinder. The cover cylinder has a diameter larger than a diameter of said side cylinder. The outer cylinder is provided with a cut portion. The shoulder wall is provided with a cut portion connecting to said cut portion of the outer cylinder. The shoulder wall is provided on a lower surface thereof with a tear off groove along the outer cylinder. The groove is connected to said cut portion of the shoulder wall. Also, a jig for holding an inner plug unrotatably is provided.

9 Claims, 11 Drawing Sheets

INNER PLUG AND CAP FOR LIQUID INJECTION CONTAINERS, AND JIG USED TO FIX CAP TO INNER PLUG

DESCRIPTION

Inner plug and cap for liquid injection containers, and jig used to fix cap to inner plug 1. Field of the Invention The present invention relates to a liquid injection container, especially relates to an inner plug and a cap for covering the inner plug for the liquid injection container enable of easily removing the inner plug from the neck of the container after using the container, further more relates to a jig for holding the inner plug used for fitting the inner plug and the cap.

2. Background of the Invention

It has been encouraged conventionally that for recycling the used liquid injection container, in case of wasting the container, the inner plug and the cap molded from different resin materials from the one of the container are removed from the neck of the container, and are wasted separately from the container.

There has been a problem, however, that a considerable force is necessary to remove the inner plug, and the inner plug attached to the neck of container by tapping cannot be separated easily. Therefore, actually the user should waste the container with the inner plug.

To solve the problem of the above, it is desired to seal the container inside completely in using it, and to obtain a cover member for the liquid injection container enable of easily removing the inner plug tapped in the neck in case of wasting it.

For the second technical background, for preventing an excess wrapping, conventional liquid injection containers having a tapped inner plug and a cap to cover the plug in capable of removing a disposable portion of a partition wall to open a pouring hole have been sold without a sealed wrapping of the cap.

However in case of preventing a sealed wrapping, for liquid injection container provided cut portions in an outer cylinder and a shoulder wall of the inner plug engaging portion to tear off the outer cylinder enable of removing the inner plug from the neck of the container easily, it is possible of intentionally removing the cap, opening the outer cylinder by pulling portion provided in the outer cylinder to cut the connecting portion and of performing to tear off the outer cylinder.

Under the conditions described hereinbefore, it is required to achieve the inner plug and the cap for the liquid injection container enable of checking from the outside a presence of a cheating on the goods in a shop without removing the cap.

In the third technical background, in a process of filling the content liquid in a container, it is conventionally practiced to tap and seal the container neck by the inner plug covered by screwing the cap after filling liquid contents in the container and to cool the liquid contents by cooling water over the container after heating and filling the container, further for screwing the cap, the inner plug is embedded in a jig and the outer circumference of the outer cylinder of the inner plug engaging portion is fastened by a holding member to prevent the inner plug from the rotation.

However it has been required to use a cap having a cover cylinder over the shoulder wall and the outer cylinder of the inner plug engaging portion to prevent a cool water from flooding into the container through a notch provided in the outer cylinder of the inner plug engaging portion and through a notch provided in the shoulder wall to connect with said notch.

Therefore there has been a new problem to be solved that due to a presence of the cover cylinder covering the outer cylinder, the outer cylinder circumference of the engaging portion cannot be fastened by the holding member and the cap cannot be screwed.

SUMMARY OF THE INVENTION

It is the first object of the present invention to provide an inner plug comprising of a cover member tapped in a liquid injection container enable of easily removing from the container neck in wasting the container and to provide a cap covering the inner plug.

In order to achieve objects of the present invention, it is provided a cover for a liquid injection container comprising an inner plug and a cap; said inner plug comprising an engaging portion to be fitted to a neck of the container, a threaded cylinder and a lip cylinder connected to said threaded cylinder; said engaging portion comprising an inner cylinder, an outer cylinder and a shoulder wall; said threaded cylinder being arranged on the inner cylinder; said cap having a side cylinder to be engaged with said threaded cylinder of said inner plug, and a cover cylinder covering said shoulder wall and said outer cylinder; said cover cylinder having a diameter larger than a diameter of said side cylinder; said outer cylinder being provided with a cut portion; said shoulder wall being provided with a cut portion connecting to said cut portion of the outer cylinder; said shoulder wall being provided on a lower surface thereof with a tear off groove along the outer cylinder; and said groove being connected to said cut portion of the shoulder wall.

It is the second object of the present invention to provide the inner plug and the cap of the liquid injection container enable of checking a breakage of the connecting portion of the outer cylinder due to a cheating on the goods without removing the cap.

To achieve the object of the above, it is provided a cover for a liquid injection container comprising an inner plug and a cap; said inner plug comprising an engaging portion to be fitted to a neck of the container, a threaded cylinder and a lip cylinder connected to said threaded cylinder; said engaging portion comprising an inner cylinder, an outer cylinder and a shoulder wall; said threaded cylinder being arranged on the inner cylinder; said cap having a side cylinder to be engaged with said threaded cylinder of said inner plug, and a cover cylinder covering said shoulder wall and said outer cylinder; said cover cylinder having a diameter larger than a diameter of said side cylinder; said outer cylinder having a connecting portion, and being provided with a cut portion; said shoulder wall being provided with a cut portion connecting to said cut portion of the outer cylinder; said shoulder wall being provided on a lower surface thereof with a tear off groove along the outer cylinder; said groove being connected to said cut portion of the shoulder wall; and an lower end of said outer cylinder extending beyond a lower end of the cylindrical wall of the cap. Also, provided is a cover for a liquid injection container comprising an inner plug and a cap; said inner plug comprising an engaging portion to be fitted to a neck of the container, a threaded cylinder and a lip cylinder connected to said threaded cylinder; said engaging portion comprising an inner cylinder, an outer cylinder and a shoulder wall; said threaded cylinder being arranged on the inner cylinder; said cap having a side cylinder to be engaged with said threaded cylinder of said inner plug, and a cover cylinder covering said shoulder wall and said outer cylinder; said cover cylinder having a diameter larger than a diameter of said side cylinder; said outer cylinder having a connecting portion, and being provided with a cut portion; said shoulder wall being provided with a cut portion connecting to said cut portion of the outer cylinder; said shoulder wall being provided on a lower surface thereof with a tear off groove along the outer cylinder; said groove being connected to said cut portion of the shoulder wall; and the outer cylinder being provided on an outer surface thereof at a lower end thereof with a flange.

For easily checking the breakage of the outer cylinder of the engaging portion, the color of the inner plug may be different from the color of the cap. For outwardly checking the condition of shoulder wall including the connecting piece of the outer cylinder, the cap may be molded from a transparent or a semitransparent resin.

It is the third object of the present invention to provide a jig for holding an inner plug unrotatably by engaging it with an engaging portion connecting to the lip cylinder of the plug.

To achieve the object of the above, it is provided a jig for holding an inner plug unrotatably; said inner plug comprising a lip cylinder, a threaded cylinder and an engaging portion; said engaging portion comprising an outer cylinder and an inner cylinder; said inner plug being provided with a lot of longitudinal ribs between the lip cylinder and the threaded cylinder; said jig comprising a column and a cylinder; said column having a diameter substantially same as a diameter of an inner surface of said inner cylinder; said cylinder extending from an outer periphery of the column and having a thickness substantially same as a space between the lip cylinder and the threaded cylinder; said cylinder being provided with slits corresponding to said longitudinal ribs. Also, it is provided a jig for holding an inner plug unrotatably; said inner plug comprising a lip cylinder, a threaded cylinder and an engaging portion; said engaging portion comprising an outer cylinder and an inner cylinder; said lip cylinder having a partition wall; said partition wall being provided on a lower surface thereof with an inner wall aligned and below the lip cylinder; said inner wall being formed with vertical ribs on an inner surface thereof; said jig comprising a holding base and a support step for receiving a lower end of the inner wall of the inner plug; said holding base being provided with vertical grooves which engage with the vertical ribs; said holding base having an outer surface which engages with an inner surface of the inner wall of the inner plug.

PREFERRED EMBODIMENTS OF THE INVENTION

The first embodiment of an inner plug and a cap for the container of the present invention will be described in conjunction with accompanied drawings.

Figure 1:
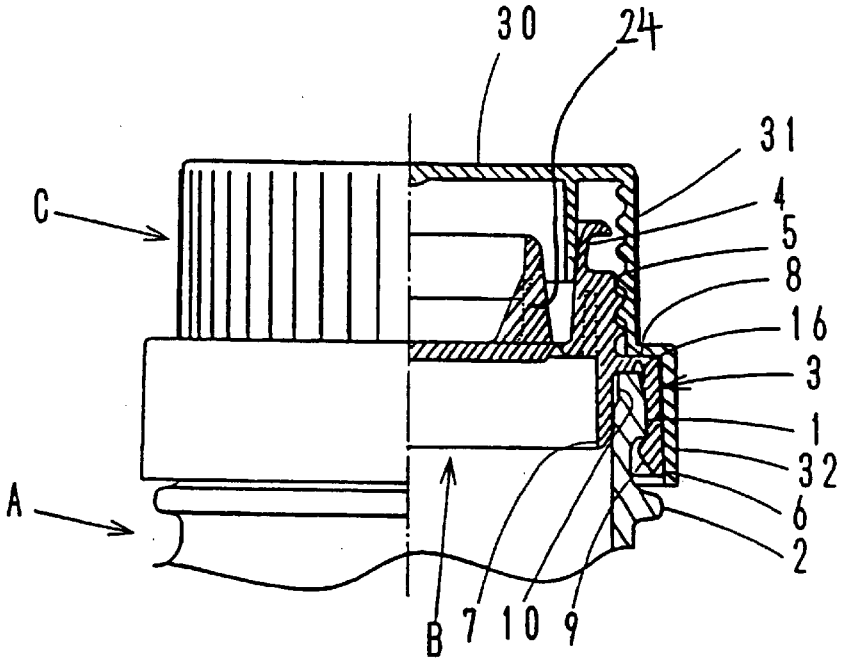
FIG. 1 is a partially cut rear view of assembling an inner plug, a cap and a neck of the container according to the first embodiment of the present invention.

In FIG. 1, "A" illustrates a cylindrical neck of a container, "B" illustrates an inner plug, and "C" illustrates a cap.

These are made of synthetic resin. The inner plug B and the cap C are formed of a different resin from the container.

The neck A of the container is provided with a protruded strip 1 and a protrusion 2 for holding.

Figure 2:
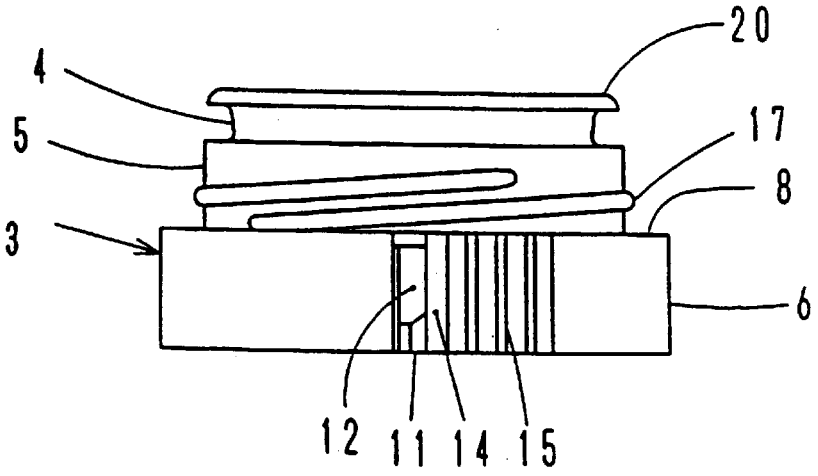
FIG. 2 is a front view of the inner plug according to the first embodiment of the present invention.
Figure 3:
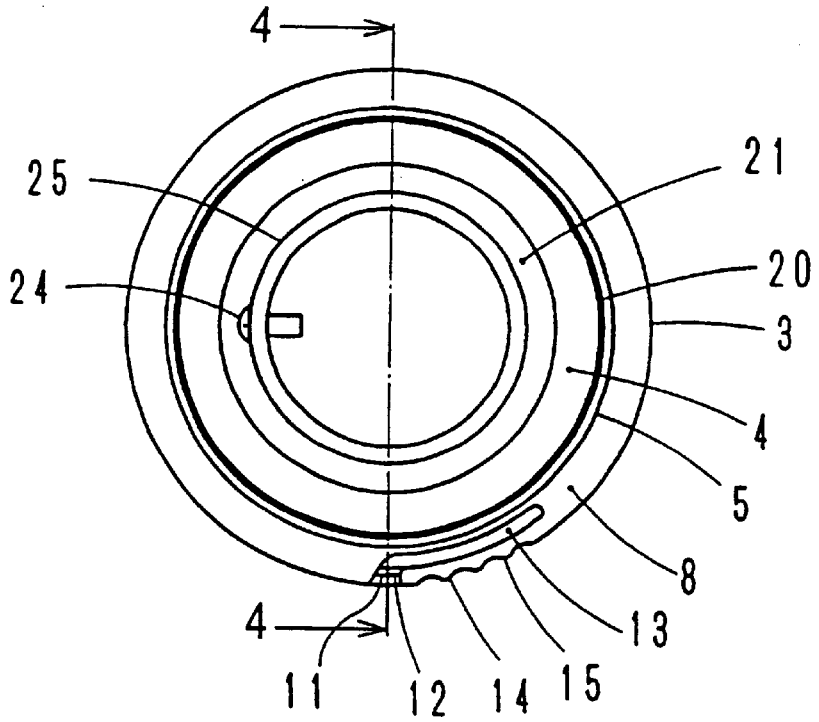
FIG. 3 is a plan view of the inner plug according to the first embodiment of the present invention.
Figure 4:
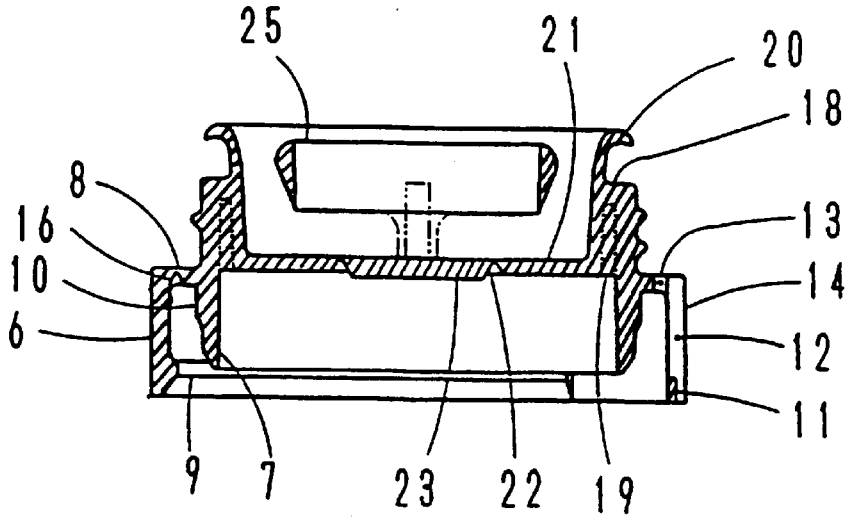
FIG. 4 is a section view along line A—A of FIG. 3.

As shown in FIGS. 2 to 4, the inner plug B comprises an engaging portion 3 for engaging the inner plug with the neck A of the container, a threaded cylinder 5, and a lip cylinder 4 connected to the cylinder 5.

The engaging portion 3 comprises an outer cylinder 6, an inner cylinder 7 and a shoulder wall 8. The cylinder 5 is extended upwardly from the inner cylinder 7.

The outer cylinder 6 is provided with a protruded strip 9 on an inner surface of the outer cylinder at a lower end portion. The strip 9 protruded inwardly, and engaged with the protruded strip 1 provided on an outer surface of the neck A. The inner cylinder 7 is provided with an expanded portion 10 on an outer surface at an upper portion, to form an interference.

When the inner plug B is fitted to the neck, the expanded portion 10 of the inner cylinder 7 is engaged with an inner surface of the neck A of the container, and the strip 9 of the outer cylinder 6 is engaged with a lower end of the strip 1 of the neck A, so as to fit the inner plug B to the neck A of the container.

The inner cylinder 7 tightly contacts with the inner surface of the neck A, and the shoulder wall 8 tightly contacts with an upper end surface of the neck A, so as to seal the container.

At a predetermined portion, the outer cylinder 6 is provided with a cut portion 12 and has a connecting portion 11. The shoulder wall 8 is provided with a cut portion 13 which extends an inner surface of the outer cylinder 6 and which continues to the cut portion 12. These cut portions constitute a tab 14 on circumferential wall of the outer cylinder 6.

A non-slip notch 15 is formed on a surface of the tab 14 to prevent fingers from slipping in case of tearing off.

The shoulder wall 8 is formed with a tear-off groove 16 having substantially V-shaped cross section view in a lower surface thereof. The groove 16 is formed in a range of at least 180° along an inner surface of the outer cylinder 6, and connects with the cut portion 13.

The threaded cylinder 5 is formed with a thread 17 on an outer surface thereof. At an upper end of the threaded cylinder 5, a support wall 18 is continuously formed, and extends inwardly. The lip cylinder 4 extends upwardly from the support wall 18.

At lower side of the support wall 18, a plurality of reinforce ribs 19 are arranged between the inner surface of the threaded cylinder 5 and the outer surface of the lip cylinder 4, so as to stably support the lip cylinder 4.

The cylinder 4 is formed with a pouring lip 20 which is bent outwardly from an upper end periphery of the cylinder 4. The cylinder 4 is also formed with a partition wall 21 at a lower end thereof.

Figure 5:
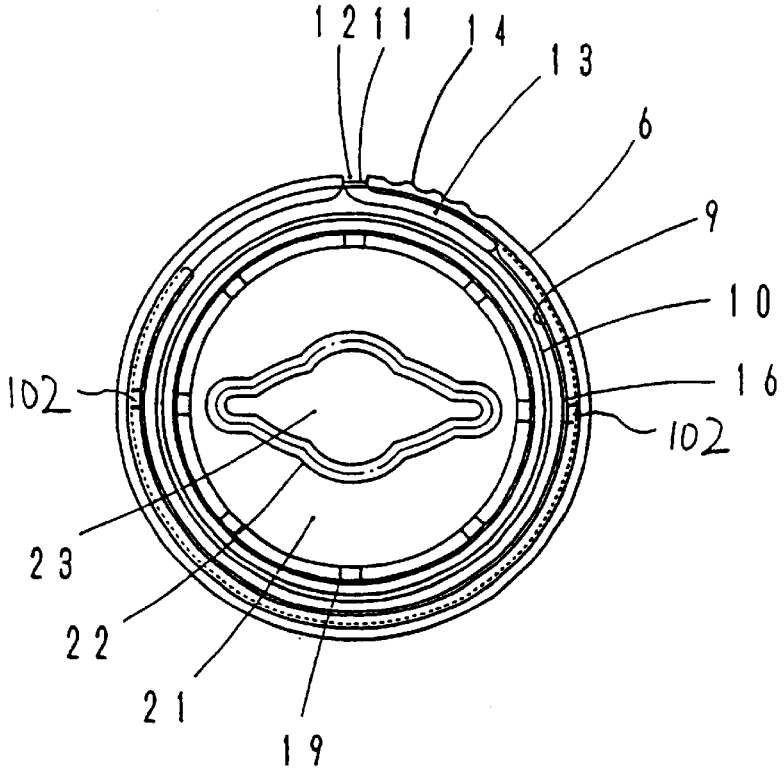
FIG. 5 is a bottom view of the inner plug according to the first embodiment.

As shown in FIG. 5, the partition wall 21 is formed with a tear-off groove 22 in a lower surface thereof. A portion of the wall 21 surrounded by the groove 22 can be removed to form a removable portion 23, which acts as an outlet of liquid when the container is used.

As shown in FIGS. 1, 3 and 4, a connecting piece 24 extends from an upper surface of the disposable portion 23, and a ring tab 25 is provided at an upper end of the connecting piece 24. Although the connecting piece 24 does not appear along A—A cross section view of FIG. 4, the piece 24 is shown by a dot line in FIG. 4 in order to show a shape of the piece 24.

Figure 6:
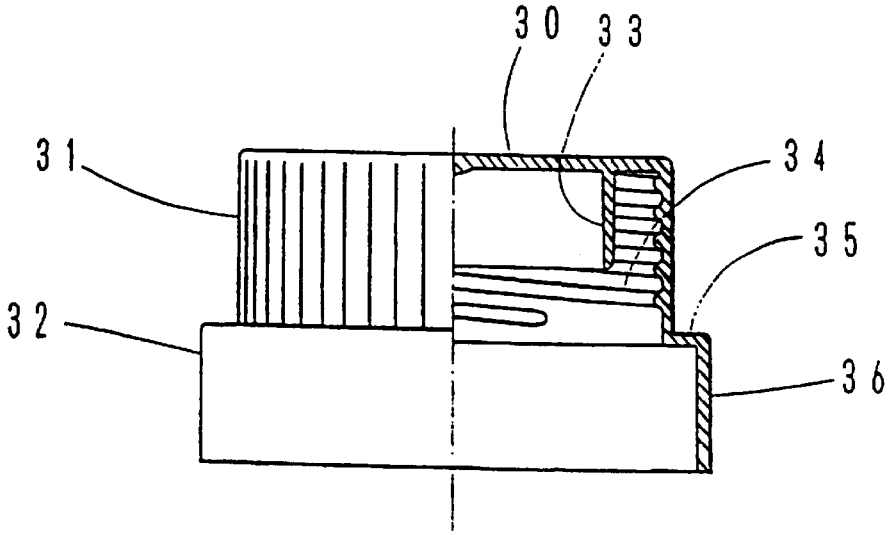
FIG. 6 is a partially cut front view of the cap according to the first embodiment.

As shown in FIG. 6, the cap C comprises a top wall 30, a side cylinder 31 and a cover cylinder 32.

The top wall 30 is provided with a sleeve 33 vertically suspended in a lower surface thereof The sleeve has a ring shape of the cross sectional view. The side cylinder 31 is formed with a thread 34 in an inner surface thereof, and the thread 34 engage with the thread 17 of the cylinder 5 of the inner plug B.

A shoulder wall or a flange 35 is arranged in a lower end of the side cylinder 31, and extends outwardly. A cylindrical wall 36 is vertically suspended from an outer periphery of the shoulder wall 35.

The cover cylinder 32 is formed by the shoulder wall 35 and the cylindrical wall 36, and contacts with the engaging portion 3 of the inner plug B.

When the cap C is threaded and fitted to the inner plug B, an outer surface of the sleeve 33 contacts with an inner surface of the lip cylinder 4 to seal the lip cylinder 4. Also, the cover cylinder 32 contacts with the shoulder wall 8 of the engaging portion 3 of the inner plug B and with an outer surface of the outer cylinder 6, to cover and fit to the inner plug.

The functional and effect of the liquid injection container of the present invention will be described hereinbelow.

The container is filled with heated and sterilized liquid, and then is cooled by a cooling water.

In this case, since the engaging portion 3 of the inner plug B is covered by the cover cylinder 32 of the cap C, the cooling water is prevented from invading into the container through the cap B, even if the cut portions 12, 13 are provided on the outer cylinder 6 and the shoulder 8 of the portion 3.

In use of the container, the ring tab 25 is pulled upwardly by a finger. The disposable portion 23 of the partition wall 21 is removed along the tear-off groove 22 to form the outlet for pouring the liquid.

When the cap C covers the inner plug B after pouring liquid, since the cover cylinder 32 covers the engaging portion 3 of the inner plug B, the shoulder wall 8 and the outer cylinder 6 of the engaging portion 3 are prevented from the dust in atmosphere, and the cut portion 13 of the shoulder wall 8 is prevented from accumulating dust.

When the used container is wasted or disposed, the tab 14 of the outer cylinder 6 is pulled outwardly, so that the groove 16 formed in the lower surface of the shoulder wall 8 is cut.

When the groove 16 is further cut beyond 180° degree, the engagement of the protruded strip 9 of the outer cylinder 6 with the protruded strip 1 of the neck A is released, so as to decrease an engagement force between the outer cylinder 6 and the neck A. Since the remained engagement force is derived from just the interference between the expanded portion 10 of the inner cylinder 7 and the inner surface of the neck A, the inner plug B can be removed easily.

The second embodiment of an inner plug and a cap for the container of the present invention will be described in conjunction with accompanied drawings.

Figure 7:
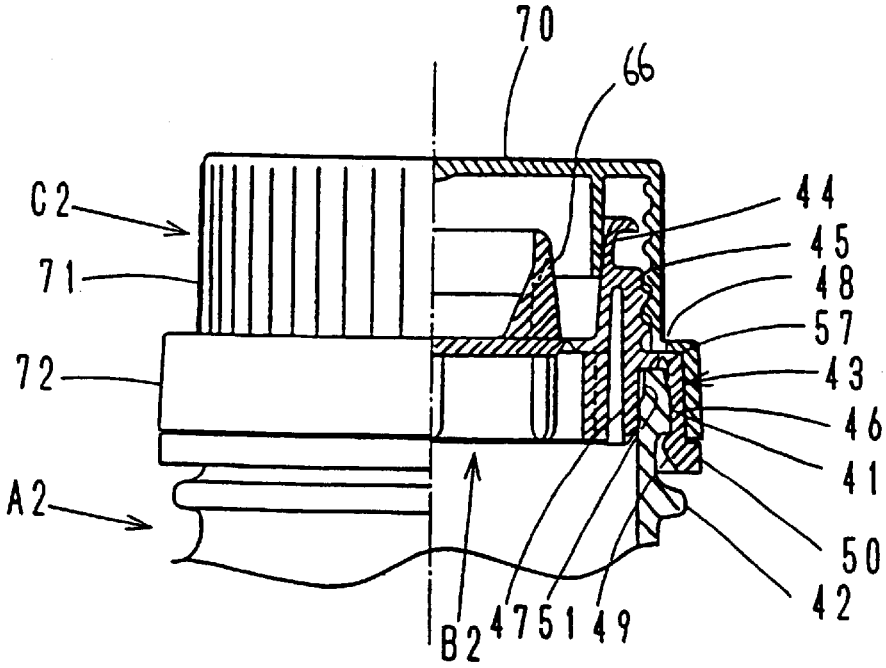
FIG. 7 is a partially cut rear view of assembling the inner plug, the cap and the neck according to the second embodiment.

In FIG. 7, "A2" illustrates a neck of the container, "B2" illustrates an inner plug, and "C2" illustrates a transparent or semitransparent cap.

The container, the inner plug B2 and the cap C2 are made of synthetic resins which are different resin one another. The cap C2 is made of a transparent or semitransparent synthetic resin.

The neck A2 of the container is provided with a protruded strip 41 and a protrusion 42 for holding.

Figure 8:
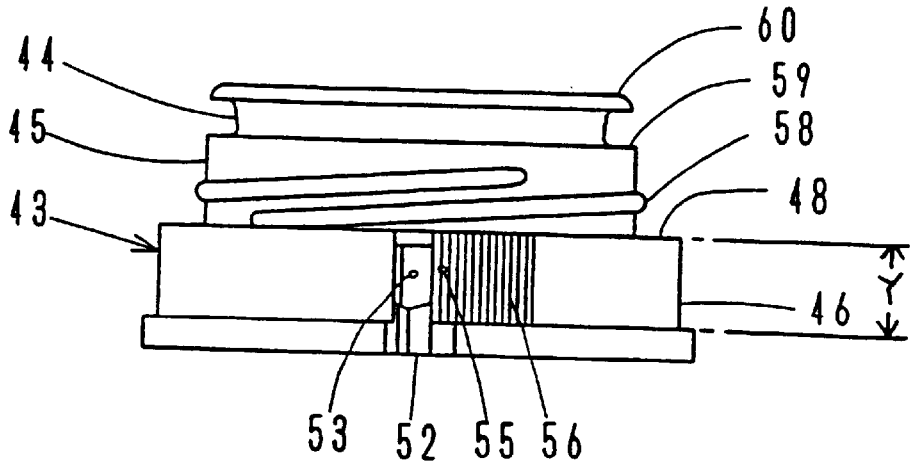
FIG. 8 is a front view of the inner plug according to the second embodiment.
Figure 9:
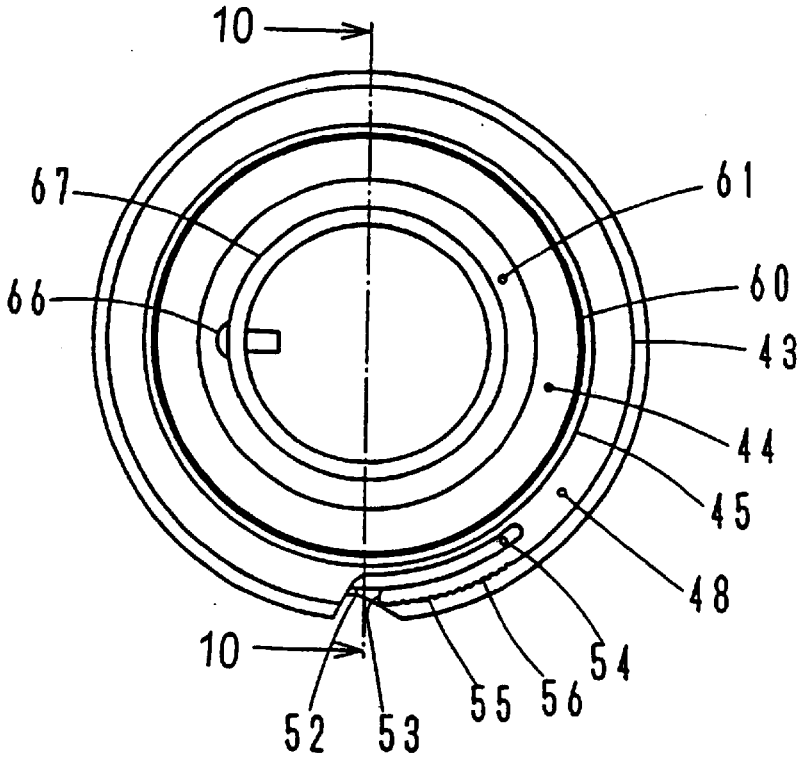
FIG. 9 is a plan view of the inner plug according to the second embodiment.
Figure 10:
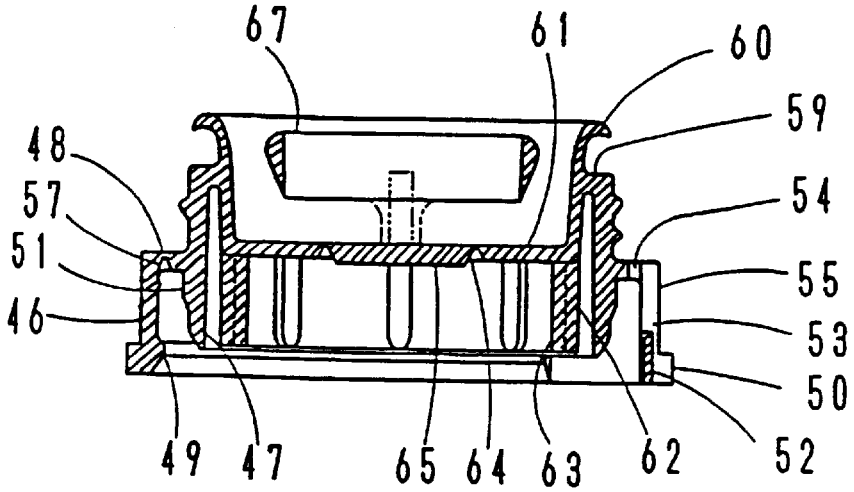
FIG. 10 is a sectional view of the inner plug along line A—A of FIG. 9.
Figure 11:
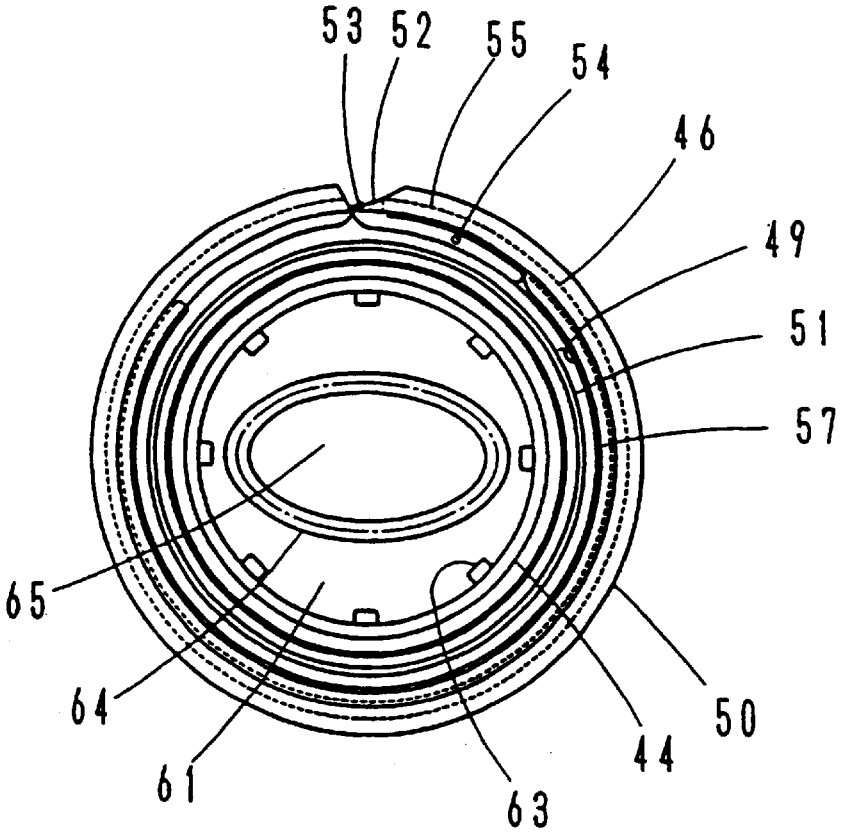
FIG. 11 is a bottom view of the inner plug according to the second embodiment.

As well as the first embodiment, as shown in FIGS. 8 to 10, the inner plug B2 comprises an engaging portion 43, a threaded cylinder 45 and a lip cylinder 44. The engaging portion 43 comprises an outer cylinder 46, an inner cylinder 47 and a shoulder wall 48.

The outer cylinder 46 is provided with a protruded strip 49 on an inner surface of the outer cylinder at a lower end portion. The strip 49 is protruded inwardly, and engaged with the protruded strip 41 provided on an outer surface of the neck A2. In the second embodiment, a flange 50 is radially outwardly protruded from an outer surface of the outer cylinder 46 at a lower end.

As well as the first embodiment, when the inner plug is fitted to the neck, an expanded portion 5 of the inner cylinder 47 is engaged with an inner surface of the neck A2 of the container, and the strip 49 of the outer cylinder 46 is engaged with a lower end of the strip 41, so as to fit the inner plug B2 to the neck A2 of the container. The inner cylinder 47 tightly contacts with the inner surface of the neck A2, and the shoulder wall 48 tightly contacts with an upper end surface of the neck A2, so as to seal the container.

As shown in FIGS. 8 to 11, the outer cylinder 46 is provided with a cut portion 53, and has a connecting portion 52 at the lower end portion thereof. The flange 50 is also provided with the cut portion. The shoulder wall 48 is provided with a cut portion 54 which extends along an inner circumference of the outer cylinder 46 so as to connect to the cut portion 53. A tab 55 is formed by the cut portions 53, 54 in the circumference wall of the outer cylinder 46. The tab 55 is formed with a non-slip notch 56 as well as the first embodiment.

The shoulder wall 48 is provided with a tear-off groove 57 in a lower surface thereof as well as the first embodiment. The groove 57 has substantially V-shaped cross sectional view. The groove 57 continues to the cut portion 54, and is formed in a range of at least 180° along an inner surface of the outer cylinder 46.

The threaded cylinder 45 is formed with a thread 58 on an outer surface thereof. A support wall 59 extends inwardly from an upper end of the cylinder 45. The lip cylinder 44 extends upwardly from the support wall 59.

The cylinder 44 is formed with a pouring lip 60 which is bent outwardly from an upper end periphery of the cylinder 44. The cylinder 44 is also formed with a partition wall 61 at a lower end thereof.

In the second embodiment, an inner wall 62 is provided on a lower surface of the partition wall 61 aligned and below the lip cylinder 44. The inner wall 62 is formed on an inner surface thereof with a plurality of vertical ribs 63 spaced apart from one another. Each of the ribs 63 extends downwardly to reach a lower end of the inner wall 62.

The partition wall 61 is formed with a tear-off groove 64 in a lower surface thereof. The groove 64 has a reverse V-shaped cross sectional view. A portion of the wall 61 surrounded by the groove 64 can be removed to form a disposable portion 65. A connecting piece 66 extends upwardly from an upper surface of the disposable portion 65, and a ring tab 67 is provided at an upper end of the connecting piece 66.

Figure 12:
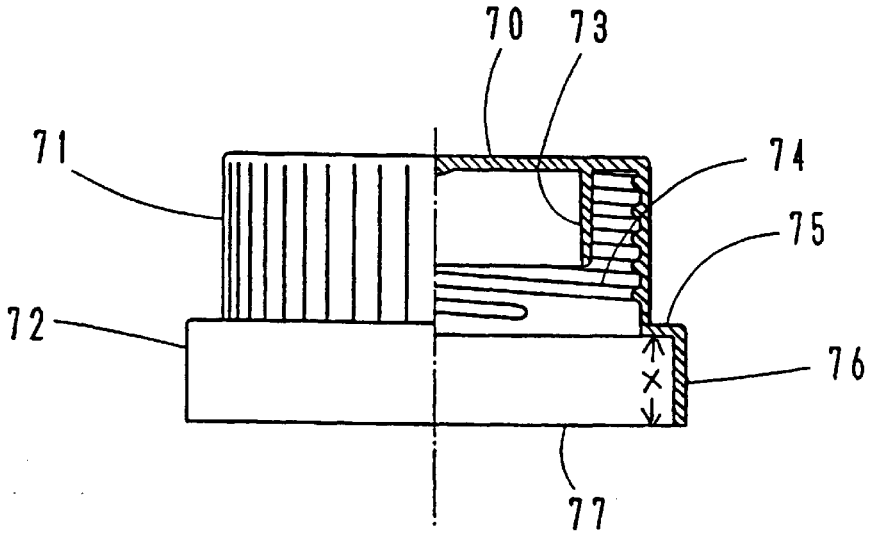
FIG. 12 is a partially cut front view of the cap according to the second embodiment.

As shown in FIG. 12, the cap C2 comprises a top wall 70, a side cylinder 71 and a cover cylinder 72. In the second embodiment, the cap C2 is transparent or semitransparent as described above.

As well as the first embodiment, the top wall 70 is provided with a sleeve 73 downwardly extended from a lower surface thereof. The side cylinder 71 is formed with a thread 74 in an inner circumference thereof. A shoulder wall or flange 75 is arranged at a lower end of the side cylinder 71. A cylindrical wall 76 is downwardly extended from an outer periphery of the shoulder wall 75.

In the second embodiment, length X (FIG. 12) between an upper end and a lower end 77 of the inner surface of the cylindrical wall 76 of the cap C2 is equal to or smaller than length Y (FIG. 8) between an upper surface of the outer cylinder 46 and an upper surface of the flange 50 of the inner plug B2. In the second embodiment, when the cap C2 is fitted to the inner plug B2, the cover cylinder 72 covers an outer periphery surface of the outer cylinder 46 above the flange 50.

The function and effect of the liquid injection container will be described hereinbelow.

In addition to the same function and effect achieved as the first embodiment, the second embodiment has following function and effect.

In a sale of containers filled with liquid contents, even if the connecting portion of the inner plug has already been broken intentionally or accidentally, it can be seen whether or not the container is suitable as goods, because the inner plug has the connecting portion 52 at the lower end of the outer cylinder 46 in addition to the flange 50, so that the connecting portion 52 can be observed even if the cap C2 is fitted.

Since the cap is transparent or semitransparent, it can be observed whether or not the groove 57 of the shoulder wall 48 is broken, in addition to the breakage of the connecting portion 52 of the outer cylinder 46.

The third embodiment referred to the inner plug and the cap will be described hereinbelow.

Figure 13:
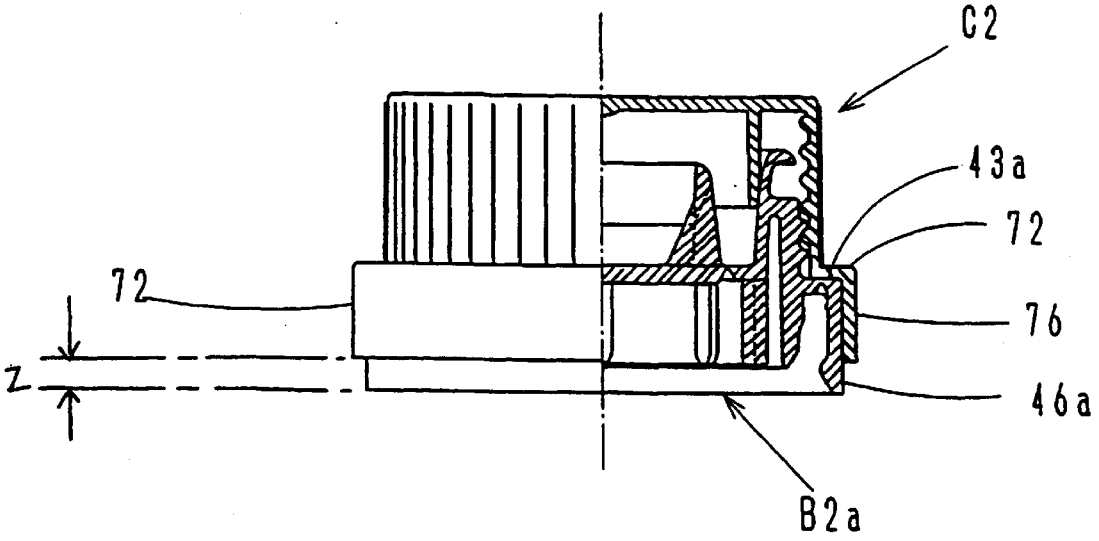
FIG. 13 is a partially cut rear view of assembling the inner plug and the cap according to the third embodiment of the present invention.

Although the second embodiment has the flange at the lower end of the outer cylinder of the inner plug, the flange can be eliminated as illustrated in FIG. 13 if the cap is transparent or semitransparent.

In FIG. 13, "B2*a*" is an inner plug, and "C2" is a cap. The inner plug B2*a* does not include *a* flange at a lower end of an outer cylinder 46*a*. In other words, an outer surface of the outer cylinder 46*a* of an engaging portion 43*a* of the inner plug B2*a* has a diameter same as that of an inner surface of the cylindrical wall 76 of the cap C2. The outer cylinder 46*a* extends beyond a lower end of the cylindrical wall 76 of the cap C2 in a range of a height "Z" which corresponds to a height of the flange. Thus, the user can see the connecting portion of the outer cylinder of the inner plug. In addition, since the cap is transparent or semitransparent, the user can see the shoulder wall through the cap.

If the cap is transparent, the cover cylinder of the cap may be designed to cover the entire outer cylinder, so as to clearly observe the shoulder wall in addition to the connecting portion through the transparent cap.

Although each of the second and the third embodiments uses the transparent semitransparent cap, the cap may have a color which is different from that of the inner plug. Since the color of the cap is different from that of the inner plug, the flange of the outer cylinder can be distinguished from the cap by a different color, so as to easily observe the connecting portion. If the groove is broken and the outer cylinder is removed, the color of the flange can not be seen, so as to recognize that such container is not suitable for goods.

If the color of the cap is different from that of the inner plug, the flange may be eliminated. It can be easily recognize whether or not a container is suitable as goods, because the color of the inner plug itself can not be observed.

The fourth embodiment referred to a jig for the holding the inner plug of the invention will be described in conjunction with accompanied drawings.

This embodiment refers to a jig for holding the inner plug used for fitting the inner plug with the cap (see FIGS. 1–6) according to the above described first embodiment.

A construction of the jig, and a relationship between the inner plug and the jig will described hereinbelow.

Figure 14:
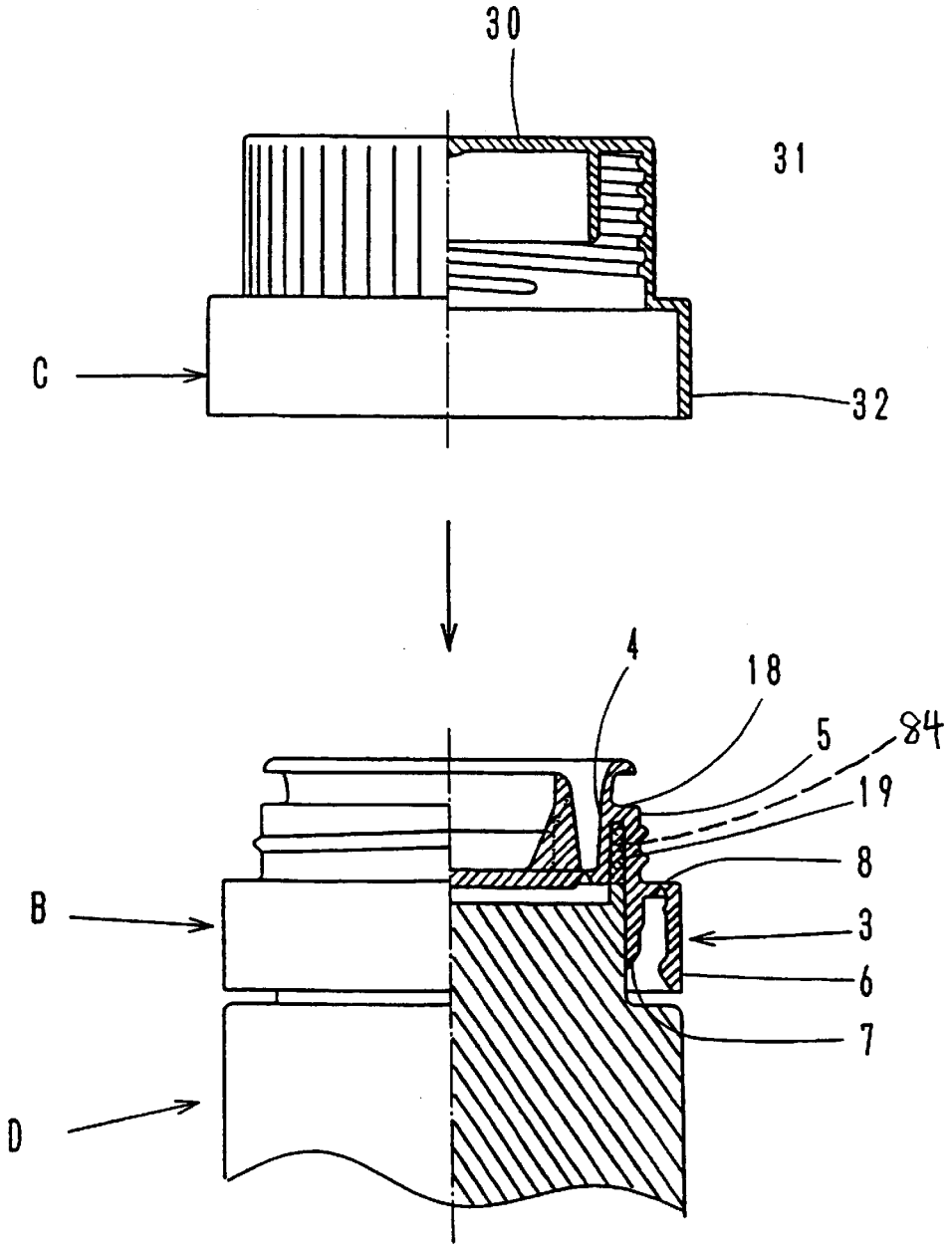
FIG. 14 is a partially cut rear view of the jig, the inner plug and the cap according to the fourth embodiment of the present invention.

In FIG. 14, "B" illustrates an inner plug, "C" illustrates a cap, and "D" illustrates a jig for holding the inner plug.

Figure 15:
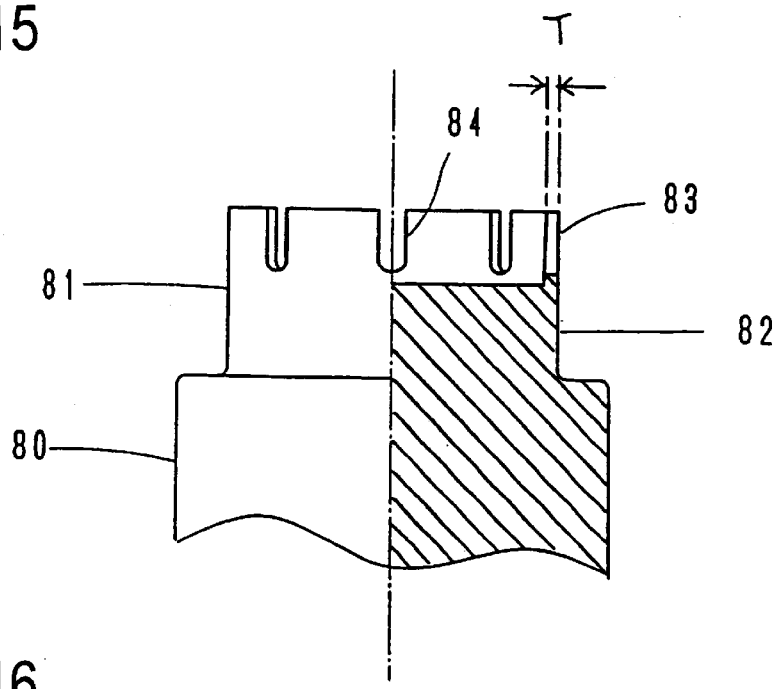
FIG. 15 is a partially cut front view of the jig of FIG. 14.
Figure 16:
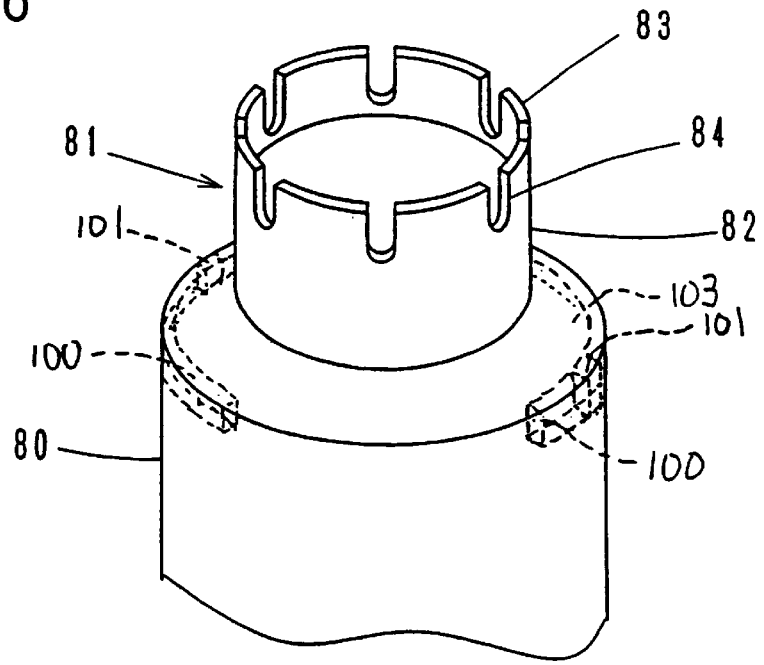
FIG. 16 is a perspective view of the jig of FIG. 14.

As illustrated in FIGS. 15 and 16 the jig D comprises a base 80 and a holding member 81 erected on the base 80.

The holding member 81 comprises a column 82 and a cylinder 83 extending upwardly from an outer circumference of the column 82. The column 82 has a same outer diameter with an inner diameter of the inner cylinder 7 of the engaging portion 3 of the inner plug B. The cylinder 83 has a thickness T equal with a space between the lip cylinder 4 and the threaded cylinder 5. The cylinder 83 is formed with a plurality of slits 84 which corresponds to the reinforce rib 19 formed between the lip cylinder 4 and the threaded cylinder 5 of the inner plug B. Each slit 84 has a width equal to a width of each of the reinforce ribs 19, so that each of the ribs 19 is inserted into each of the slits 84.

The embodiment how to use of the jig and the function and the effect thereof will be described hereinbelow.

After filling liquid in the container, the inner plug of the present invention is screwed with the cap, and is then fitted to the neck of the container.

When the inner plug is screwed to the cap C, the inner cylinder 7 of the engaging portion 3 of the inner plug B is inserted in the cylinder 83 of the holding member 81 of the jig, and the reinforce ribs 19 of the inner plug B is pressed to insert into the slit 84. An edge of the cylinder 83 is inserted to contact with the support wall 18 of the lip cylinder 4 of the inner plug B, so as to engage the column 82 with the inner cylinder 7.

Thus, the inner plug B is supported to the jig D incapable of rotating each other, so that the cap C can be easily screwed with the inner plug B.

In the illustrated embodiment, the reinforce rib 19 is engaged with the slit 84 of the jig D. Alternatively, a lot of longitudinal holes having circular cross sectional shape may be formed between the lip cylinder 4 and the threaded cylinder 5, and a lot of longitudinal strips may be projected from the cylinder 83 of the jig D, so as to insert the strips into the holes.

The fifth embodiment will be described hereinbelow, and relates to a jig for screwing and fitting the cap to the inner plug of the second embodiment (see FIGS. 7 to 12).

Figure 17:
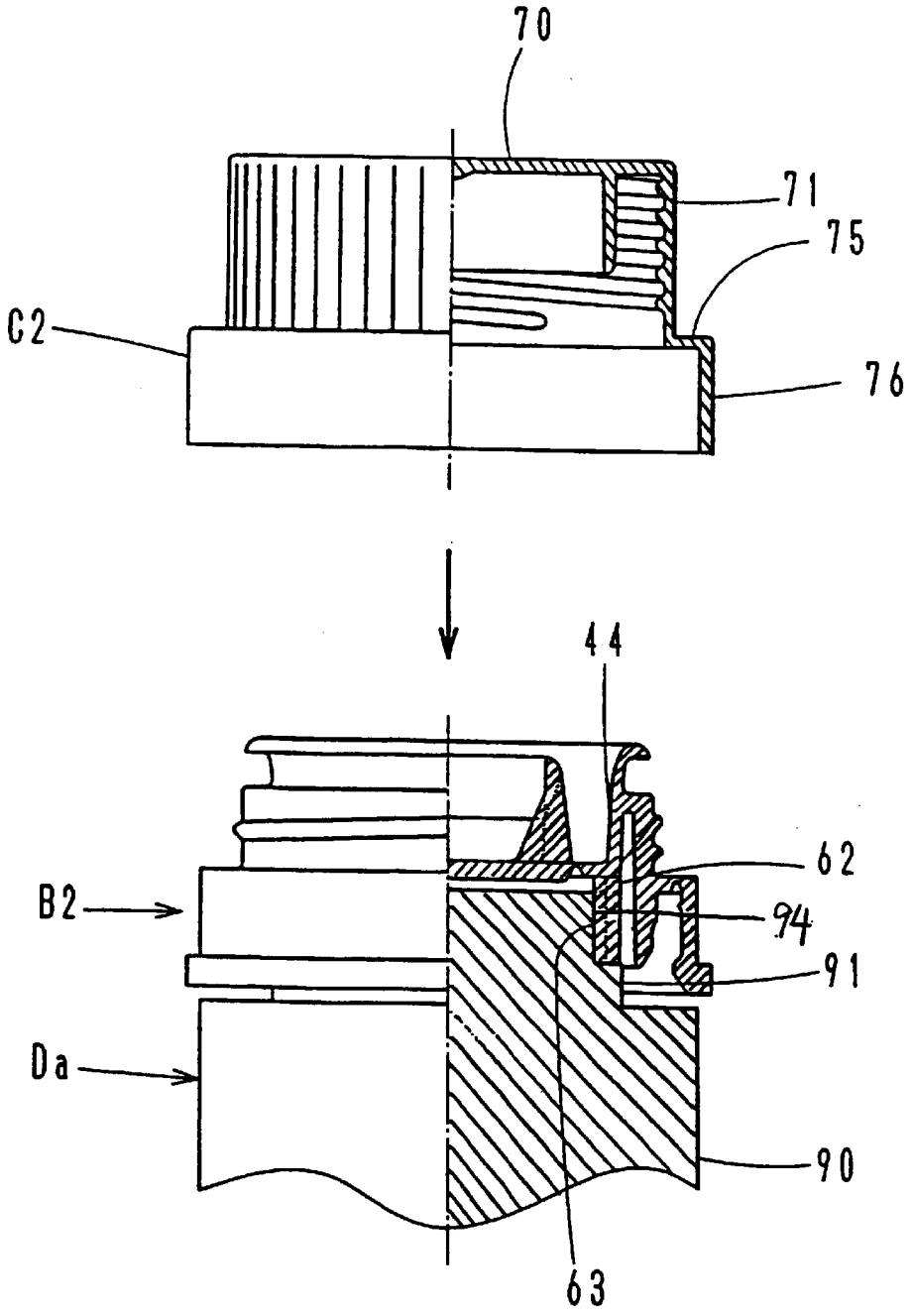
FIG. 17 illustrates the fifth embodiment of the present invention and is a partially cut rear view of the jig, the inner plug and the cap.

In FIG. 17, "B2" is an inner plug, "C2" is a cap and "Da" is a jig of the inner plug.

Figure 18:
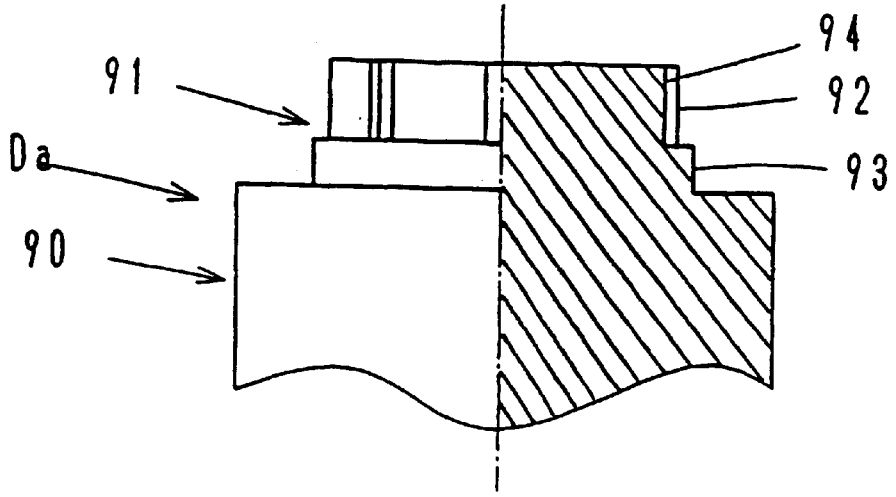
FIG. 18 is a partially cut-away front view of the jig of FIG. 17
Figure 19:
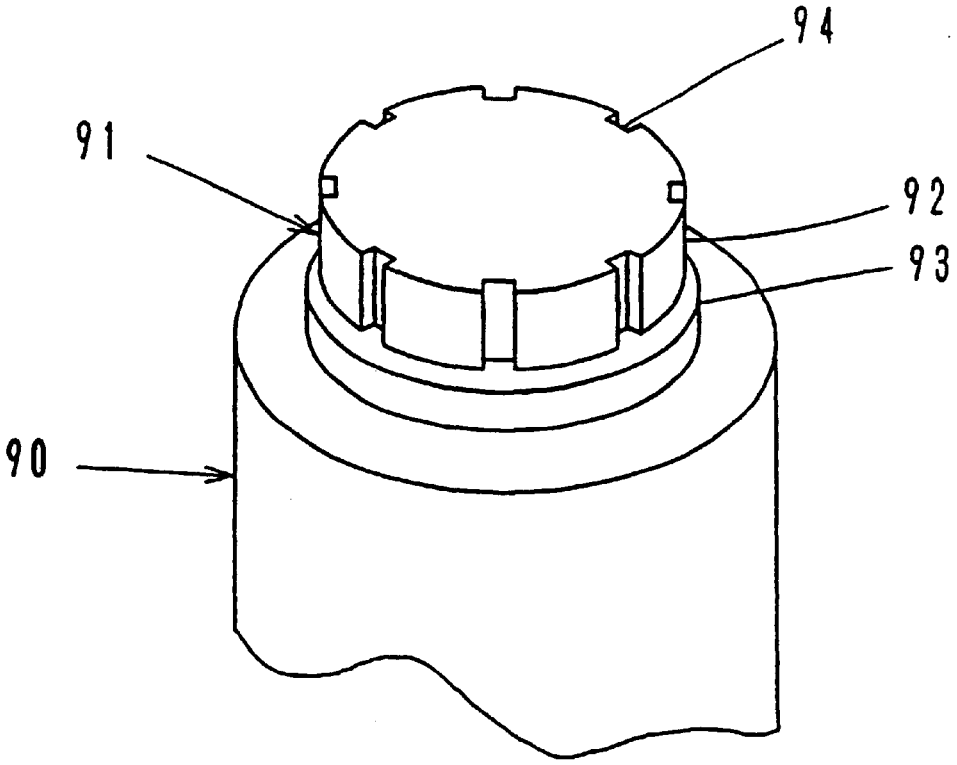
FIG. 19 is a perspective view of the jig of FIG. 17.

As shown by FIGS. 18 and 19, the jig Da comprises a base 90 and a holding member 91 erected from the base 90 coaxially.

The holding member 91 comprises a holding base 92 and a support step 93. The holding base 92 has a diameter same as the inner circumference of the inner wall 62 which downwardly extends from the lip cylinder 44 of the inner plug B2. The support step 93 receives a lower end of the inner wall 62. The holding base 92 is formed on an outer surface thereof with a plurality of vertical grooves 94 equally spaced. Each of the vertical grooves 94 has a width substantially equal to that of the vertical rib 63 of the inner plug, and extends from an upper end of the holding base 92 to the support step 93.

The function and the effect of the fifth embodiment will be described.

Each of the vertical ribs 63 on the inner wall 62 of the inner plug B2 is inserted to each of the vertical groove 94 of the jig Da, and is pushed such that the lower end of the inner wall 62 contacts with the support step 93, so as to fix the inner plug B2 to the holding base 92 of the jig Da.

Therefore, the inner plug B2 is unrotatably held by the jig Da as well as the fourth embodiment, so that the cap C2 can be screwed and engaged to the threaded cylinder 45 of the inner plug B2.

In an illustrated embodiment, the inner plug B2 is formed with the vertical rib 63 at the inner wall 62, and the jig Da is formed with the vertical groove 94 at the holding base 92 as described above. Alternatively, the inner wall 62 may be formed with a slit or a groove, and the holding base 92 of the jig Da may be formed on the surface thereof with a protruding strip which is engaged with the groove.

In place of the slit 84 as shown by FIGS. 15 and 16 and of the vertical groove 94 as shown by FIGS. 18 and 19, a concave depressed step portion 100 may be formed in an outer periphery 103 on a top surface of the base 80 as shown by a dotted line in FIG. 16. The protruded strip 9 illustrated in FIG. 5 is disposed at the concave depressed step portion 100. The step portion 100 is formed with protrusions 101, and the protruded strip 9 is formed with notches 102 (FIG. 5), each of which corresponds with each of the protrusions 101. Since the protrusions 101 of the jig are inserted into the notches 102, the jig prevents the inner plug from rotating each other.

The reinforce rib 19 in the fourth embodiment, the longitudinal hole formed between the lip cylinder 4 and the threaded cylinder 5 in the modified embodiment of the fourth embodiment, the vertical rib 63 in the fifth embodiment, and the slit or groove in the modified embodiment of the fifth embodiment act as the engaging piece, and these are engaged with the jig so as to hold the inner jig unrotatably.

In each embodiment described hereinbefore, the cover cylinder of the cap covers the outer cylinder of the engaging portion of the inner plug. However, the inner plug of the present invention may be applicable for using the cap having no cover cylinder, and in this case, holding members for preventing the rotation is not necessary, so as to become the construction of the jig simple.

Since the present invention has the above described constructions, the present invention has the following effects.

In the first embodiment as referred to the inner plug and the cap, since the tear-off groove is formed on the lower surface of the shoulder wall of the engaging portion of the inner plug in a predetermined range along the outer cylinder inner circumference, the tear-off groove can be broken by pulling the tab of the outer cylinder to tear off the outer cylinder circumferential wall along the tear-off groove.

Therefore the inner plug can be easily removed to waste the container, the inner plug and the cap separately.

Since the cover cylinder is mounted in the cap to cover the outer cylinder and the shoulder wall of the engaging portion of the inner plug, for cooling the container after heating and filling the contents, the container can be prevented from cooling water flooding through the cut portion and from the dust adhered on the engaging portion of the inner plug in using the container.

In the second and the third embodiments, since the cover cylinder of the cap does not cover the flange of the outer cylinder lower end of the inner plug or the lower end portion of the outer cylinder, the connecting portion of the outer cylinder lower end can be observed without removing the cap to check the presence of the cheating on the goods.

Further, when the cap is formed in a transparent or a semitransparent, not only the condition of the connecting portion of the outer cylinder of the inner plug but also of the condition of the shoulder portion can be observed from upside of the cap to check the applicability of the connecting portion and the presence of breakage of the shoulder wall or the cheating on the container.

When the color of the cap is different from that of the inner plug, the outer cylinder of the inner plug can be distinguished from the upside of the cap to be capable of checking the condition of the connecting portion.

Even if the tear-off groove of the shoulder wall is broken or the outer cylinder is removed, the cheating on the container can be immediately checked by a colorless flange.

For jig of the inner plug, since a positioning member is mounted to contact with the lip cylinder of the inner plug, the engage portion such as the groove, and since the convex lip or the slit is disposed in the jig to engage with the positioning member, the inner plug is supported in preventing from the rotation, and conventional inner plug for holding the outer cylinder of the plug is not necessary.

As described hereinbefore, the inner plug and the cap of the liquid injection container of the present invention is useful for a closure member to seal the inside of the container, especially the inner plug can be removed from the container neck easily after using the contents liquid therein, thereby the container, the inner plug and the cap can be wasted separately.

Therefore the waste container can be prevented from being mixed of different kinds of materials, and can be useful for recycling plastic materials.

Furthermore in the jig of the inner plug, since the jig is engaged with the engaging portion connected to the lip cylinder of the inner plug, the rotation of the inner plug can be prevented completely and the simple structure thereof can be useful for the jig.

What is claimed is:

1. A cover for a liquid injection container comprising an inner plug and a cap, said inner plug comprising an engaging portion to be fitted to a neck of the container, a threaded cylinder and a lip cylinder connected to said threaded cylinder, said engaging portion comprising an inner cylinder, an outer cylinder and a shoulder wall, said threaded cylinder being arranged on the inner cylinder, said cap having a side cylinder to be engaged with said threaded cylinder of said inner plug, and a cover cylinder covering said shoulder wall and said outer cylinder, said cover cylinder having a diameter larger than a diameter of said side cylinder, said outer cylinder being provided with a cut portion, said shoulder wall being provided with a cut portion connecting to said cut portion of the outer cylinder, said shoulder wall being provided on a lower surface thereof with a tear off groove along the outer cylinder, and said groove being connected to said cut portion of the shoulder wall.

2. A cover member of a liquid injection container according to claims 1, wherein the cap is molded from a transparent or a semitransparent synthetic resin.

3. A cover member of a liquid injection container according to claim 1, wherein a color of the inner plug is different from a color of the cap.

4. A cover for a liquid injection container comprising an inner plug and a cap, said inner plug comprising an engaging portion to be fitted to a neck of the container, a threaded cylinder and a lip cylinder connected to said threaded cylinder, said engaging portion comprising an inner cylinder, an outer cylinder and a shoulder wall, said threaded cylinder being arranged on the inner cylinder, said cap having a side cylinder to be engaged with said threaded cylinder of said inner plug, and a cover cylinder covering said shoulder wall and said outer cylinder, said cover cylinder having a diameter larger than a diameter of said side cylinder, said outer cylinder having a connecting portion, and being provided with a cut portion, said shoulder wall being provided with a cut portion connecting to said cut portion of the outer cylinder, said shoulder wall being provided on a lower surface thereof with a tear off groove along the outer cylinder, said groove being connected to said cut portion of the shoulder wall, and an lower end of said outer cylinder extending beyond a lower end of the cylindrical wall of the cap.

5. A cover member of a liquid injection container according to claims 4, wherein a color of the inner plug is different from a color of the cap.

6. A cover member of a liquid injection container according to claim 4, wherein the cap is molded from a transparent or a semitransparent synthetic resin.

7. A cover for a liquid injection container comprising an inner plug and a cap, said inner plug comprising an engaging portion to be fitted to a neck of the container, a threaded cylinder and a lip cylinder connected to said threaded cylinder, said engaging portion comprising an inner cylinder, an outer cylinder and a shoulder wall, said threaded cylinder being arranged on the inner cylinder, said cap having a side cylinder to be engaged with said threaded cylinder of said inner plug, and a cover cylinder covering said shoulder wall and said outer cylinder, said cover cylinder having a diameter larger than a diameter of said side cylinder, said outer cylinder having a connecting portion, and being provided with a cut portion, said shoulder wall being provided with a cut portion connecting to said cut portion of the outer cylinder, said shoulder wall being provided on a lower surface thereof with a tear off groove along the outer cylinder, said groove being connected to said cut portion of the shoulder wall, and the outer cylinder being provided on an outer surface thereof at a lower end thereof with a flange.

8. A cover member of a liquid injection container according to claim 7, wherein a color of the inner plug is different from a color of the cap.

9. A cover member of a liquid injection container according to claim 7, wherein the cap is molded from a transparent or a semitransparent synthetic resin.

* * * * *